US005246358A

United States Patent [19]

Gu

[11] Patent Number: 5,246,358

[45] Date of Patent: Sep. 21, 1993

[54] CAM-GEAR PUMP-COMPRESSOR APPARATUS

[76] Inventor: Inhoy Gu, 420-503, Jukong Apt., Dunchon-Dong, Kangdong-Gu, Seoul, Rep. of Korea

[21] Appl. No.: 951,784

[22] Filed: Sep. 28, 1992

[30] Foreign Application Priority Data

Jan. 16, 1992 [KR] Rep. of Korea ..... 92-535

[51] Int. Cl.[5] ..... F01C 1/20

[52] U.S. Cl. ..... 418/191

[58] Field of Search ..... 418/191, 112, 113

[56] References Cited

U.S. PATENT DOCUMENTS

| | | | |
|---|---|---|---|
| 2,790,394 | 4/1957 | Mori | 418/113 X |
| 2,963,981 | 12/1960 | Hanatsuka | 418/191 |
| 3,218,984 | 11/1965 | Mosovsky | 418/191 X |

FOREIGN PATENT DOCUMENTS

| | | | |
|---|---|---|---|
| 1305741 | 8/1962 | France | 418/191 |
| 1350628 | 12/1963 | France | 418/113 |
| 527000 | 5/1955 | Italy | 418/191 |

*Primary Examiner*—Richard E. Gluck
*Attorney, Agent, or Firm*—Hill, Steadman & Simpson

[57] ABSTRACT

A compressor-pump apparatus utilizing a cam gear 13 with a plurality of teeth 14 and a roller gear 21 with a plurality of rotatable rollers 10, with the gears being in mechanical communication is disclosed. A housing 18 having an inlet port 19 and an outlet port 20 and an interior wall 18C which substantially encloses the cam gear 13 and the roller gear 21. Upon rotation of the roller gear, each roller sequentially rollingly contacts the housing to thereby trap at least a portion of fluid present in the inlet port 19 in a pocket 12 which is formed between adjacent rollers 10B and a portion 18B of the interior wall 18C of the housing 18 between adjacent rollers 10B. Upon rotation of the cam gear each tooth sequentially proximately contacts the interior wall 18C of the housing 18 thereby trapping at least a portion of fluid present in the inlet port 19 in a chamber 26 formed between adjacent gear teeth 14B and a portion 18A of the internal wall 18C of the housing 18 in proximate contact with adjacent gear teeth 14B. Upon further rotation of the cam gear and the roller gear, the trapped fluid in the pocket 12 and the chamber 26 is transported to the outlet port 20 to enable pressurized fluid flow from the inlet port 19 to the outlet port 20. Preferably, grooves 22, 23 are formed on the cam-gear surface to enable fluid communication between a housing interior and a cavity 30 formed during meshing of adjacent rollers 10B with one of teeth of the cam gear 13.

29 Claims, 6 Drawing Sheets

CAM-GEAR PUMP-COMPRESSOR APPARATUS

BACKGROUND OF INVENTION

1. Field of the Invention

This invention relates to an apparatus for use as either a rotary pump for liquids or a compressor for gases, and more particularly to a housing which includes a cam gear having gear teeth in rolling contact with rollers of a roller gear and which, upon rotation of the cam gear and roller gear, the fluids supplied through an inlet port is trapped in a moving chamber existing between adjacent gear teeth and portions of the internal wall of the housing in proximate contact with the adjacent gear teeth and in a moving pocket existing between adjacent rollers and a portion of the internal wall of the housing in contact with the adjacent rollers thereby transporting the fluid to an outlet port at an increased pressure.

2. Related Invention

See related U.S. Application entitled Cam Gear Assembly, Ser. No. 814,411, filed Dec. 23, 1991, which discusses the fabrication and operation of the cam-roller gear system.

3. Information Disclosure Statement

Rotary pumps for pressurizing liquid and rotary compressors for pressurizing gas are a positive-displacement type of apparatus which operate without the need for valves on either the suction and dischage ports. Gear pumps utilizing a type of straight spur gear are presently utilized. However, the disadvantages of the present gear pumps include a high level of noise created during operation and low mechanical efficiency. Low efficiency is due to the fact that liquid trapping between gear and pinion gear teeth during the double contact therebetween (meshing) may cause backlash displacement during operation of the pump and a portion of high pressure fluid may leak back to the low pressure side through the backlash of the gear teeth. Backlash displacement may also occur when the pump is not in operation. Also, the line of contact between mating gears has a sliding component, and leakage may occur across the contact line. Thus, such gear pump apparatus can not be used as a compressor of gaseous fluids.

Another disadvantage of the gear pump is that for a given gear size, displaced volume is increased by increasing the addendum short of creating interference of mating gears. Other rotary pumps and compressors, such as the two- or three-lobe pump and compressor are constructed with external pilot gears since power can not be transferred between the shafts themselves. Thus, leakage usually occurs across the sliding contact line of the impeller and housing at high pressure.

Therefore, the principal object of the present invention is to provide a mechanism for a rotary pump-compressor which operates without the backlash of the prior art devices and which also does not require external pilot gears for operation.

Another object of the present invention is to replace the line of contact of the sliding gear teeth of the prior art devices by a line of contact utilizing a compressed rolling action of the present invention.

Another object of the present invention is to provide a rotary pump and a rotary compressor apparatus with reduced operational friction during meshing of the gears.

Another object of the present invention is to provide a rotary pump-compressor which has a large displacement volume for a given gear size.

Another object of the present invention is to provide a rotary pump-compressor which substantially eliminates the trapping of fluids between mating gears thereby increasing efficiency.

The preceding objects should be construed as merely presenting a few of the more pertinent features and applications of the invention. Many other beneficial results can be obtained by applying the disclosed invention in a different manner or modifying the invention within the scope of the disclosure. Accordingly, other objects and a fuller understanding of the invention may be had by refering to both the summary of the invention and the detailed description, below, which describe the preferred embodiment in addition to the scope of the invention defined by the claims considered in conjunction with the accompanying drawings.

SUMMARY OF THE INVENTION

The pump-compressor apparatus of the present invention is defined by the claims with a specific embodiment shown in the attached drawings. For the purpose of summerizing the invention, the invention relates to a cam gear 13 having a plurality of teeth 14 and a roller gear 21 having a plurality of rotatable rollers 10, with the cam gear and the roller gear in mechanical communication, i.e. meshed. A housing 18 with an inlet port 19 and an outlet port 20 is used. The housing further includes an interior wall 18C which substantially encloses the cam gear 13 and the roller gear 21. Upon rotation of the roller gear, each roller sequentially rollingly contacts the interior wall of the housing thereby trapping a portion of fluid present in the inlet port 19 in a pocket 12 formed between adjacent rollers 10B and a portion 18B of the interior wall 18C of the housing between the adjacent rollers 10B. Also, upon rotation of the cam gear, each tooth sequentially proximately contacts, i.e. either does not or only minimally frictionally engages or slides on the interior wall, the interior wall 18C of the housing thereby trapping a portion of fluid present in the inlet port 19 in a chamber 26 formed between adjacent gear teeth 14B and a portion 18A of the interior wall 18C of the housing 18 in proximate contact with the adjacent gear teeth 14B. Upon further rotation of the cam gear and the roller gear the trapped fluid in the pocket 12 and the chamber 26 is transported to the outlet port 20 to enable pressurized fluid flow from the inlet port 19 to the outlet port 20.

As appreciated by those skilled in the art, the exact portion of the interior wall 18C which defines part of the pocket, changes as the roller gear rotates within the housing as a result of the rollers traveling along the interior wall as the pocket is "moved." In like manner, the exact portion of of the interior wall 18C which defines part of the chamber, changes as the cam gear rotates within the housing as a result of the teeth 14B traveling along the interior wall as the chamber is "moved."

Preferably, the adjacent teeth 14B of the plurality of teeth of the cam gear form a notch 16 which defines a lobular periphery having a pair of sides with a root 15 therebetween and with the plurality of teeth being equally spaced apart relative to one another in rotational symmetry. The grooves enable, in use, upon rotation of the cam gear and the roller gear, each roller to rollingly contact one of the sides of the lobular periphery and roll along the lobular periphery whereby the friction upon mechanical engagement of the cam gear and the roller gear is decreased.

The roller and the cam gears are preferably configured to provide at least one of the teeth of the cam gear to be in rolling contact with both a roller of the roller gear in an approach phase and with a roller of the roller gear in a recess phase to provide mechanical communication between the roller gear and the cam gear.

In the preferred embodiment, each tooth 14A of the plurality of teeth of the cam gear 13, includes a first side 14C and a second side 14D with each side having at least one groove formed therein to enable fluid communication between the housing interior and a cavity 30 formed during meshing of the adjacent rollers with one of the cam gear. That is, a cavity 30 is defined by surface portions of adjacent rollers and surface portions of the tooth meshing between the adjacent rollers. This enables, in use, fluid trapped in the cavity 30 to flow in the groove 22 formed in one of the sides of the tooth to the outlet port 20 as the tooth moved toward being equally positioned between the adjacent rollers and upon further rotation of meshed gears as the tooth moves away from being equally positioned between the adjacent rollers enables fluid in the inlet port to flow in the remaining groove 23 formed in the side of the tooth into the cavity 30. Such action occurs no matter what the direction of rotation. It is most preferred all the teeth include at least one grooves formed therein. For the use of incompressible fluids, all the teeth must include at least one groove on the gear-tooth surface. However, it is important to note that the grooves formed on each side of a tooth and are not connected together across the top of the tooth, as illustrated at FIG. 2 and FIGS. 3A–3D. If the grooves are not formed as described above, then there must be some other means, such as backlash displacement during meshing of the gears, to allow fluid which would otherwise be trapped between the meshing teeth, which would impair or inhibit rotation, to escape to enable the gears to rotatably mesh. However, in this case leakage between the high and low pressure sides will likely to occur.

The present invention utilizes cam-gear action, with each tooth preferably having a top land in a sliding surface-contact, i.e. no or minimal frictional engagement, with the inner surface of the housing (close clearance), and the rollers of the roller gear are in rolling line-contact with the inner surface of the housing. Most preferably each tooth of the plurality of teeth 14 of the cam gear 13 further include a top land 17 which is contoured to fit the interior contour of the housing wall.

The name "cam gear" is derived from its function where gear motion is performed with a rotational-cam curve replacing the conventional gear-tooth profile. The roller gear performs gear action by using rollers instead of gear teeth.

The cam gear and roller gear are preferably mounted on parallel shafts, and mesh with each other in rolling contact. The roller gear comprises a center plate with a plurality of rollers positioned on a channeled edge of the center plate. Each roller is in an equal distance from the center point of the center plate and rollers are equally spaced about the edge of the center plate. The rollers are positioned on the plate in close clearance between contacting surfaces and, in use, (meshing) the channels receive the cam gear teeth. Preferably, the channels between adjacent rollers which are provided in the center plate to allow the cam-gear teeth to be received therein upon meshing are lobular shaped channels.

The rollers are preferably supported by discs 27 secured to each side of the roller gear. The discs rotatably support each of the plurality of rollers therebetween and are fixed to the rotating shaft of the roller gear or to the roller gear itself.

The cam gear is made to have a tooth profile that permits rolling contact of rollers on it at all positions of the cam gear. The rollers maintain contact with the cam-gear tooth during the entire process from the approach phase to the cam gear until the recess phase from the cam gear. When a gear tooth advances between adjacent rollers during meshing, fluid is trapped in the cavity 30, since the rollers are in close contact with both sides of the gear tooth. At least one groove is formed on the gear tooth surface so that the trapped fluid can flow back into the high pressure port during the advancement of of the tooth between adjacent rollers, i.e. the cavity pressure is greater than the pressure of the outlet port. In the same manner, when a gear tooth retreats from the adjacent rollers, negative pressure builds up since the rollers are in close contact with both sides of the gear tooth. At least one groove is formed on the gear tooth surface so that the fluid in the inlet port may be drawn or sucked into the cavity, i.e. the pressure in the cavity is lower than the pressure in the inlet port. Preferably, multiple grooves are formed in each side of the tooth.

Unlike the conventional gears of involute curve, the cam-gear tooth profile, which is also a cam curve of rolling rollers, preferably includes a fixed distance of the gear centers for a constant ratio of rotational velocity. The fixed distance of the gear centers can be ensured by mounting both the cam gear and the roller gear to shafts so that both shafts are pressured of forced against on each other.

BRIEF DESCRIPTION OF THE DRAWINGS

For fuller understanding of the nature and objects of the invention, reference should be had to the following detailed description taken in conjunction with the accompanying drawings in which.

Similar reference characters refer to similar parts throughout the several views of the drawings.

DETAILED DESCRIPTION OF THE INVENTION

Figure 1:
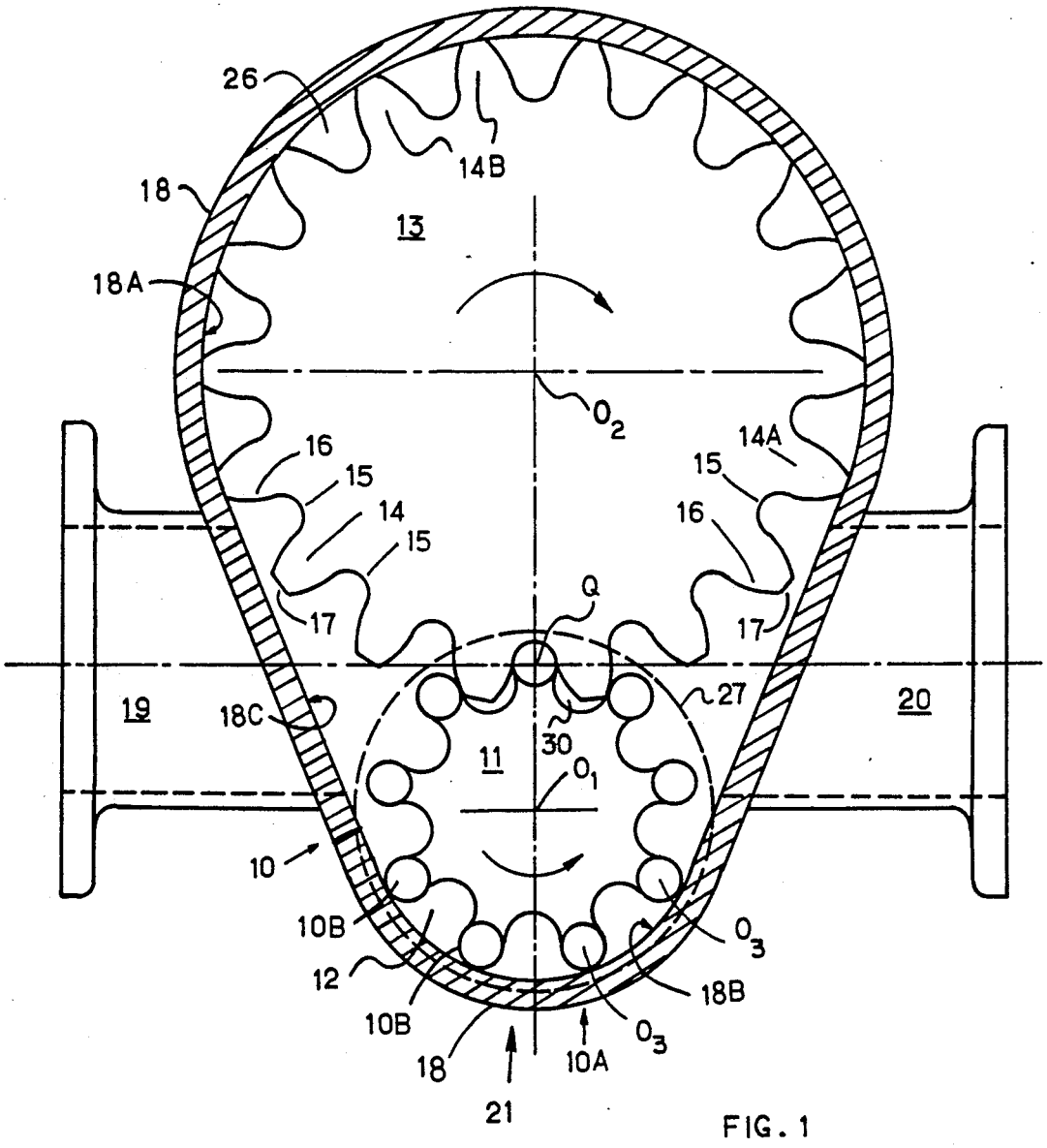
FIG. 1 is a side elevational cross sectional view of the embodiment of the present invention.

FIG. 1 illustrates the preferred embodiment of the invention wherein each roller 10A of the roller gear 21 has a cylindrical shape and is positioned in a direction which is perpendicular to the plane of rotation of the roller gear, and each tooth of the cam gear is positioned within the plane of rotation of the cam gear. The cam gear 13 is a plate-shaped cam having toothed profiles to permit the rollers of the roller gear to roll along the profile at a constant ratio of rotational velocities of the cam gear and the roller gear. The name "roller gear" indicates that the gear motion is performed with rollers instead of gear teeth, and the name "cam gear" means that the gear motion is performed by cam action in engaging the rollers on the gear-tooth profile. The cam gear 13 is rigidly secured to a shaft $O_2$ by aligning centers, and the roller gear 21 is rigidly secured to a shaft $O_1$ positioned parallel to the shaft $O_2$.

The housing 18 substantially encloses both the cam gear and the mating roller gear to permit the presence of an inlet port 19 or low pressure side and an outlet port 20 or high pressure side in the housing as illustrated in FIG. 1. When the cam gear 13 rotates clockwise, the roller gear 21 rotates counterclockwise with the result that the port 19 becomes a suction port and port 20 becomes a discharge port. Upon changing of the rotational direction of the gears, the designation of the ports as being suction and discharge also changes. Also, the direction of flow in the groove would change upon changing the rotational ditection of the gears. Thus, upon counterclockwise rotation of the cam gear 13, the function of the suction and discharge grooves are switched, and the approach and recess phases of the rollers are also switched. During the change of the rotation, as the rollers do not lose contact with the gear tooth, there is no backlash displacement. Therefore, there is no leakage from the high pressure port to the low pressure port upon stopping the rotation of the gears. Thus, the present invention provides a structure for a bi-directional pump and a bi-directional compressor.

The roller gear 21 includes a plurality of rollers 10A with each roller being an equal distance from the center of the gear 21 and preferably equally spaced about the gear relative to one another. The rollers are rotatably supported by the discs 27 positioned on both sides of the roller gear and which are each secured to the plate 11 of the roller gear. The rollers are then rotatably secured to and extend in between the discs. The rollers are free to rotate in a close clearance with the plate. Each disc may further include a plurality of holes 33 formed therein to rotatably mount the roller between two of the plurality of holes formed in the disc. Other methods of roller gear fabrication are within those skilled in the relavant art.

The plate 11 of roller gear has lobular-shaped channels between adjacent rollers to provide a minimum necessary space for an engaging tooth of the cam gear. During the rotation of the roller gear 21, the fluid trapped in the pockets 12 enclosed by both rollers and the housing is fed into the discharge port at a higher pressure. At the same time, the rollers roll along the inner surface of the housing.

The rollers of the roller gear 21 can be made to have a cylindrical shape or any other axisymmetric shape, and then the gear-tooth surface and the interior housing wall should then have a shape to matingly receive the axisymmetric roller shape.

The cam gear 13 has a plurality of teeth 14A equally spaced about the pheriphery thereof. As each tooth 14A of the cam gear 13 engages a roller 10A of the roller gear 21, the angular velocity ratio r is expressed as in the number of cam-gear teeth $N_c$ and the number of rollers of the roller gear $N_r$.

$$r=N_r/N_c$$

The pitch radius of the cam gear is denoted by $O_2Q$ in FIG. 1, where the pitch point Q divides the center distance $O_1O_2$ in an adverse proportion to the ratio of rotational velocities, since the circumferential velocities of the cam gear and the roller gear should be the same at point Q. Thus, the relationship between the center distance and the radius $R_1$ of the roller gear is $$O_1O_2=R_1+R_1/r$$

Figure 2:
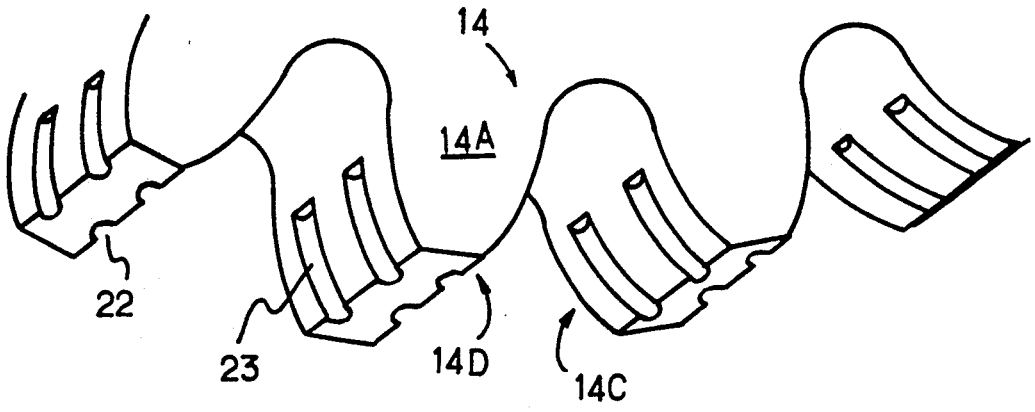
FIG. 2 is a schematic diagram of cam-gear teeth showing the suction grooves and discharge grooves on the gear-tooth surface.

During the rotation of cam gear 13, the fluid trapped between the adjacent gear teeth 14B and the inner wall of the housing, which forms a chamber 26 is fed into the discharge port of a higher pressure. Thus, the clearance between the surface of the tooth and the housing is small, with the top land 17 of each gear tooth preferably being rounded in the same circular arc as the arc of the inner surface of the housing, as illustrated at FIG. 1. Preferably, on both surfaces of gear teeth, grooves are formed through which fluids may flow, as schematically shown in FIG. 2.

FIGS. 3A–3D are partial views of the present invention of FIG. 1, with the cam gear 13 rotating clockwise and the roller gear 21 rotating counter-clockwise. The function and length of the grooves are illustrated in FIG. 3A–D in a stepped sequential motion of gear teeth mating with rollers.

Figure 3A:
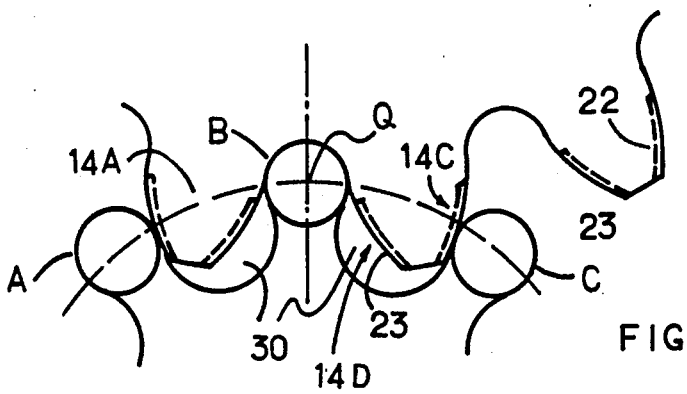
FIG. 3A–D show stepwise motion of a rotating cam gear and a rotating roller gear.

In FIG. 3A, three rollers of the roller gear are contacting the cam gear teeth 14A. Upon clockwise rotation of the cam gear 13, the roller C advances into the cam gear, and the roller A retreat from the cam gear, and the roller B, at the pitch point Q, ends an approach phase and begins a recess phase. Since the root 15 of lobular-notch 16 between cam-gear teeth is in a close clearance relationship with the roller of the roller gear, fluid should not flow around the roller B. Thus, the circular-arc root tightly engages the roller. Upon further rotation of the cam gear and the roller gear, the gear tooth between roller B and roller C advances into the cavity 30 between adjacent rollers, and trapped fluid in this space is forced out along the discharge groove 22 and back into the high pressure port. At the same time, the gear tooth between roller A and roller B retreats from the cavity 30 between the adjacent rollers, which builds up negative pressure, so that the fluid is drawn into the cavity 30 through the suction groove 23 which is opposite the discharge groove 22.

Figure 3B:
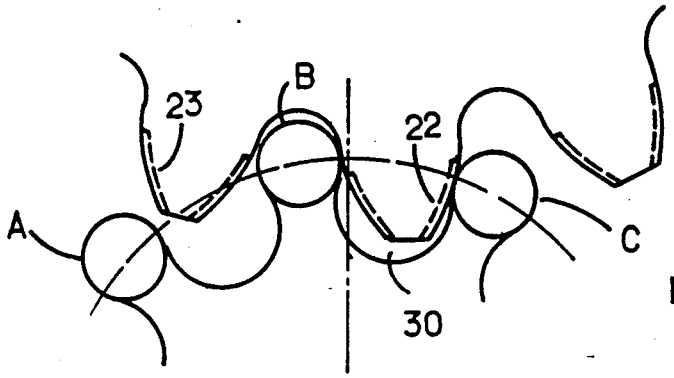

In FIG. 3B, the roller A loses contact with the cam gear, and the gear tooth contacts both the roller C in an approach phase and the roller B of a recess phase.

Figure 3C:
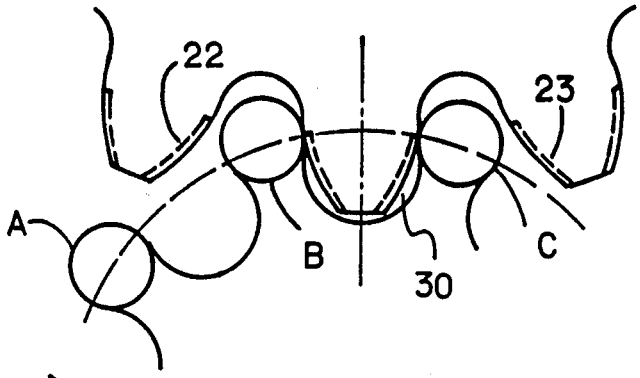

FIG. 3C corresponds to the position when the roller gear rotates from the position in FIG. 3A by a half angle between rollers, $\theta_0/2$. At this position, the roller B and roller C contact the gear tooth symmetrically about the centerline, and the gear tooth between the rollers ends advancing into the cavity 30 between adjacent rollers of the roller gear and begins retreating therefrom. Accordingly, the discharge process of the trapped fluid in the cavity stops and the suction process of drawing fluid into the cavity 30 begins. The length of the grooves is determined from the position at which the rollers on both surfaces of the gear tooth close off the grooves, as shown in FIG. 3C.

The fluid occupying the volume of the cavity 30, including the grooves in the gear teeth in FIG. 3C, is returned to the inlet port 19, which decreases the efficiency of the apparatus. Thus, the size of the cavity 30 should be minimal, i.e. of a size only enough to permit an engaging gear tooth to enter and retreat from the cavity. In this case, or where the grooves are present, the flow rate may be calculated from the volumes of voids between gear teeth and between rollers which are enclosed by the interior wall of the housing, i.e. the chamber 26 and pocket 12, respectively, minus the cavity 30 volume, including that of the grooves in the gear teeth in FIG. 3C.

Figure 3D:
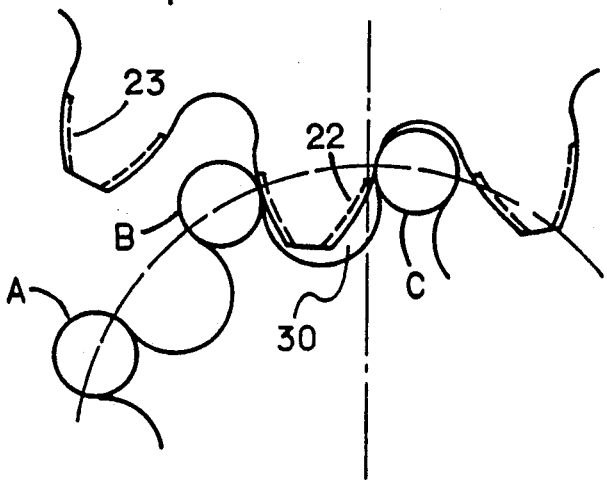

Further rotation brings the cam gear to the position in FIG. 3D, at which the lower pressure fluid is sucked into the cavity 30 along the suction groove 23. Upon further rotation, the roller gear rotates from the position of FIG. 3C by a half angle between adjacent rollers, $\theta_0/2$, to bring the cam gear to the position of FIG. 3A. The steps illustrated in FIGS. 3A, 3B, 3C, and 3D are sequentially repeated.

Since there are always two or more points of contact between the gears, at least one in approach and the other(s) in recess, the motion of the cam gear is securely controlled by the rotation of a roller gear 21 so that cam gear 13 can not jump from the roller 10. Thus, the present invention does not need an external pilot gear to ensure the controlled motion.

The involute curve of conventional-gear tooth profile allows some variation of distance between shaft centers while maintaining a constant ratio of rotational velocities of shafts. However, the present invention preferably includes a fixed center distance between the roller gear and the cam gear, which can be accomplished by mounting both a cam gear and a roller gear to shafts so that both shafts are slightly forced against each other.

Figure 4:
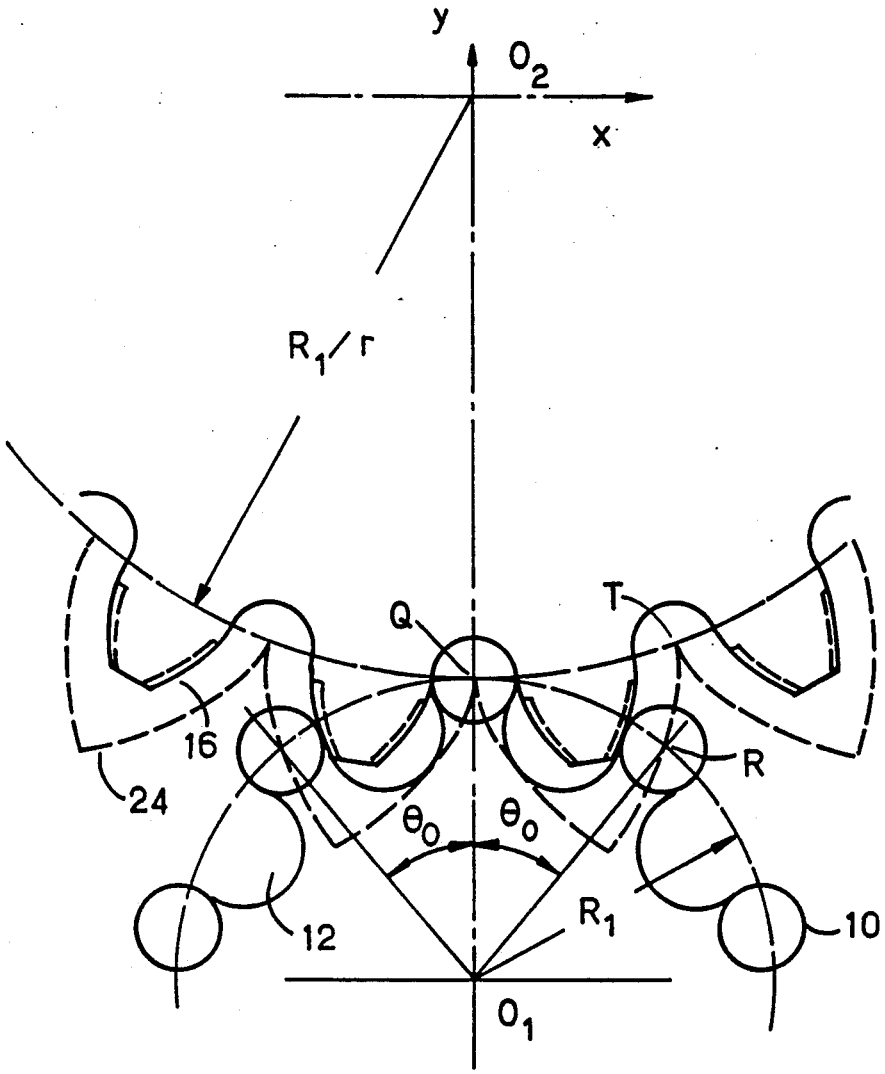
FIG. 4 is a detailed view of the cam-gear-tooth profile contacting rollers of a roller gear in a coordinated frame.

FIG. 4 is a detailed view around the contact points of the cam gear and roller gear, with coordinates for deriving the cam-gear tooth profile which permits the contact of the roller to the cam-gear tooth surface in the entire process from an approach to a recess phase. In order to ensure more-than-two contact points between the rollers and cam-gear surface, the velocity ratio should be kept less than 1 ($r \leqq 1$). Denoting the angular interval between adjacent rollers in $\theta_0$, the angular interval between adjacent cam-gear teeth is $r\theta_0$.

The pitch curve 24, illustrated as a dashed line in FIG. 4, is the path of the roller center on the plane of a cam gear 13 while the roller 10 is in mesh with the cam gear 13. The cam-gear profile 16 is determined by the distance of the roller radius from the pitch curve 24. The common normal to the surfaces at the contact point in FIG. 4 should intersect the line of centers at the pitch point Q dividing the center distance $O_1O_2$ by the angular velocity ratio. Thus, the point on the cam-gear profile 16 must lie on the common normal in the distance of a roller radius from the center of roller. Even though the cam-gear profile may vary according to the radius of the roller, the pitch curve is fixed for given numbers of rollers and gear teeth and center distance. The involute curve of conventional gears has a constant pressure angle. However, in the present invention, the pressure angle, as the roller 10 moves from the position R to the position Q, varies from $\theta_0/2$ to zero.

Figure 5:
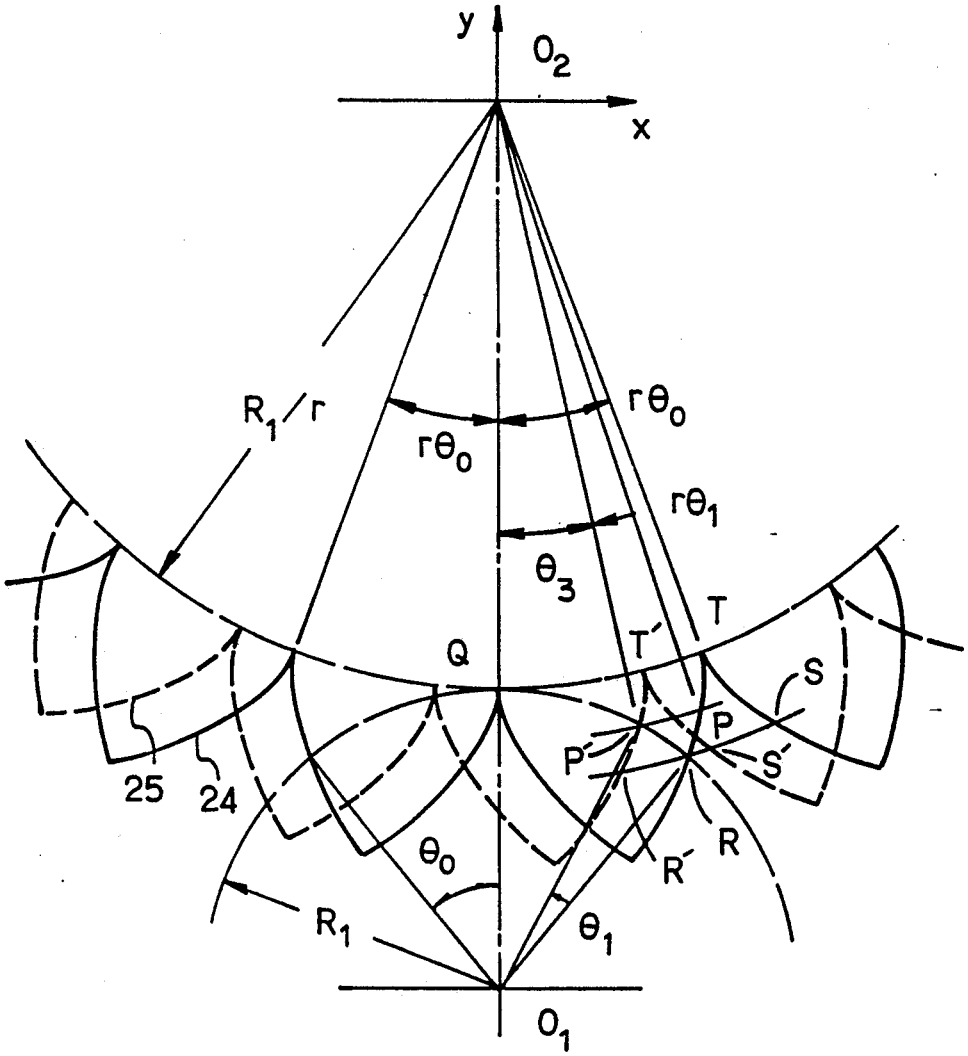
FIG. 5 shows coordinates for calculating the pitch curve of the cam gear along which the centers of rollers of a roller gear travel in mesh with the cam gear.

The coordinates of a pitch curve 24 are illustrated in FIG. 5, where the roller center $O_3$ are in the radial distance $R_1$ from the shaft $O_1$, and the pitch point Q is on the centerline in the distance $R_1/r$ from the shaft $O_2$. Counterclockwise rotation of the roller gear through the angle $\theta_0$ moves the roller at R to the position Q while the cam gear rotates counterclockwise through the angle $r\theta_0$ about the point $O_2$, from the position T to the position Q. The angle $r\theta_0$ is the angle between adjacent cam gear teeth.

The calculation of coordinates of the pitch curve is explained as follows. While the roller at R rotates counterclockwise through an angle $\theta_1$ to the position P', the pich curve STPR in the solid line rotates clockwise through the angle $r\theta_1$ to the pitch curve S'T'P'R', represented by the dashed line 25 in FIG. 5. The coordinates of the point P on the pitch curve are calculated using the coordinates of the point P'. The angle $\theta_3$ of the point P' from the center line has a following trigonometric relationship.

$$\tan\theta_3 = \left[\frac{R_1\sin(\theta_o - \theta_1)}{R_1 - R_1\cos(\theta_o - \theta_1) + R_1/r}\right]$$

and the radial distance of the point P' from the cam-gear center $O_2$ is $$O_2P' = \frac{R_1\sin(\theta_o - \theta_1)}{\sin\theta_3}$$

The point P is obtained by rotating the point P' counterclockwise through the angle $r\theta_1$.

$$x\text{-}coordinate\ of\ point\ P = O_2P'\sin(r\theta_1 + \theta_3)$$

$$y\text{-}coordinate\ of\ point\ P = -O_2P'\cos(r\theta_1 + \theta_3)$$

In the above equations, incremental variations of the angle $\theta_1$ from zero to $\theta_0$ determine the curve RT, which corresponds to the phase of the roller approach from R to Q. Incremental variations of the angle $\theta_1$ from $\theta_0$ to $2\theta_0$ determine the curve TS, which corresponds to the recess of the said roller. The said two curves RT and TS are symmetrical to each other about the radial line $O_2T$, so the cam gear can rotate in either direction. The pitch curve prior to the point R is calculated from the above equations by varying the angle $\theta_1$ incrementally from $-\beta$ to zero, in which the angle $\beta$ satisfies the following condition.

$$\left(1 + \frac{1}{r}\right)\sin\left(r\beta + \frac{r\theta_o}{2}\right) = \sin\left(\theta_o + \beta + r\beta + \frac{r\theta_o}{2}\right)$$

The pitch curve beyond the point S is calculated similarly by varying the angle $\theta_1$ from $2\theta_0$ to $2\theta_0+\beta$, in which the angle $\beta$ also satisfies the above condition. The cam profile corresponding to the pitch curve prior to R and beyond S is introduced to increase the number of contact points between cam gear and rollers. In order to get the entire cam profile, the cam profile corresponding to the pitch curve RTS and its extended part should be repeated rotationally in an angular-space $r\theta_0$ about the point $O_2$. Accordingly, 360 degrees divided by $r\theta_0$ degrees should be the same as the number of cam-gear teeth.

Figure 6:
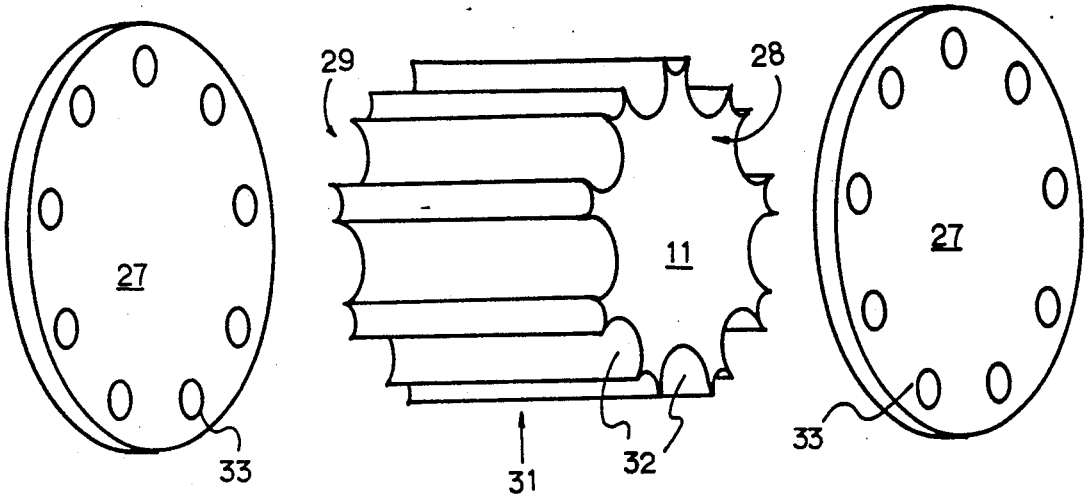
FIG. 6 is an exploded view of the roller gear according to the present invention.

FIG. 6 illustrates the roller gear 13 according to the present invention. The roller gear 21 comprises a center plate 11 having an edge 31 with a plurality of channels 32 axially formed in and evenly spaced about the edge of the plate. The channels receive, in use, the teeth 14 of the cam gear 13. The roller gear further include a first 28 and a second 29 side with a disc 27 secured to each side for rotatably supporting therebetween each roller of the plurality of rollers positioned next to each channel. Each roller is mounted to the roller gear in a close clearance relationship to the center plate 11 and to the periphery holes 33 of discs 27.

Although the invention has been illustrated by way of the preferred embodiment thereof, it should be understood that various changes and modifications may be made in the form, construction and arrangement of the parts without departing from the spirit and scope of the invention.

What is claimed is:

1. A pump-compressor apparatus comprising:

a cam gear 13 having a plurality of teeth 14 with each tooth 14A of said pluality of teeth of said cam gear 13 including a first side 14C and a second side 14D with each said side having at least one groove formed therein;

a roller gear 21 having a plurality of rotatable rollers 10, with said cam gear and said roller gear in mechanical communication; and a housing 18 having an inlet port 19 and an outlet port 20 and an interior wall 18C substantially enclosing said cam gear 13 and said roller gear 21 such that, in use, upon rotation of said gears, each said roller sequentially rollingly contacts said housing thereby trapping a portion of fluid present in said inlet port 19 in a pocket 12 formed between adjacent rollers 10B and a portion 18B of said interior wall 18C of said housing between said adjacent rollers 10B and each said tooth sequentially proximately contacts said housing thereby trapping a portion of fluid present in said inlet port 19 in a chamber 26 formed between adjacent gear teeth 14B and a portion 18A of said internal wall 18C of said housing 18 in proximate contact with said adjacent gear teeth 14B and to enable fluid communication between said housing interior and a cavity 30 formed during meshing of said adjacent rollers 10B with one of said teeth 14A of said cam gear such that, upon rotation, fluid trapped in said cavity 30 flows in said groove formed in one of said sides of said tooth to said outlet port 20 and upon further rotaton of said meshed gears fluid in inlet port flows in said groove formed in the remaining side of said tooth into said cavity 30 and to transport said trapped fluid in said pocket 12 and said chamber 26 to said outlet port 20 to enable pressurized fluid flow from said inlet port 19 to said outlet port 20.

2. The apparatus of claim 1 wherein adjacent teeth of said plurality of teeth of said cam gear form a notch 16 defining a lobular periphery having a pair of sides and with said plurality of teeth being equally spaced apart relative to one another; and said plurality 10A of rotatable rollers 10 of said roller gear being equally spaced apart relative to one another in rotational symmetry such that, in use, upon rotation of said cam gear and said roller gear, each said roller rollingly contacts one of said sides of said lobular periphery and rolls along said lobular periphery thereby decreasing friction upon mechanical engagement of said cam gear and said roller gear.

3. The apparatus of claim 2 wherein said roller and said cam gears are configured to provide at least one of said teeth of said cam gear to be in rolling contact with both a roller of said roller gear in an approach phase and with a roller of said roller gear in a recess phase to provide mechanical communication between said roller gear and said cam gear.

4. The apparatus of claim 2 wherein each said notch of said cam gear 13 further includes a circular-arc root 15 and each said roller having a surface contour to matingly receive said circular-arc root 15.

5. The apparatus of claim 2 wherein each said roller 10 of said roller gear 21 has an axisymmetrical shape, and each said notch 16 between said adjacent teeth 14B of said cam gear 13 and said inner surface of said housing 18 has a surface contour to matingly receive said axisymmetrical shape.

6. The apparatus of claim 1 wherein said interior housing wall is contoured and each tooth of said plurality of teeth 14 of said cam gear 13 further includes a top land 17 which is shaped to fit said contour of said interior housing wall.

7. The apparatus of claim 1 wherein said cam gear 13 and said roller gear 21 are each mounted on a shaft $O_1$, $O_2$, respectively, with said shafts being forced together in order to keep said shafts at a constant distance relative to one another to aid in preventing backlash displacement between said mating cam gear and said roller gear.

8. The apparatus of claim 1 wherein each said side of each said tooth includes a pair of grooves 22, 23 formed therein and each said tooth includes a top land 17 with each said groove extending from said top land to a position where said roller closes off said grooves when said roller is positioned symmetrically between adjacent teeth of said cam gear.

9. The apparatus of claim 1 wherein said cam gear 13 and said roller gear 21 are fixedly mounted on parallel shafts, respectively.

10. The apparatus of claim 1 wherein each said roller 10A of said roller gear 21 has cylindrical shape, and said tooth said teeth of said cam gear being positioned in a direction perpendicular to the plane of rotation.

11. The apparatus of claim 1 wherein said roller gear 21 comprises a center plate 11 having an edge 31 with a plurality of channels 32 axially formed in and evenly spaced about said edge of said plate for receiving, in use, said plurality of teeth 14 of said cam gear 13 and further including a first 28 and a second 29 side with a disc 27 secured to each said side for rotatably supporting therebetween each said roller of said plurality of rollers positioned next to each channel of said plurality of channels.

12. A pump-compressor apparatus comprising:

a cam gear 13 having a plurality of teeth 14;

a roller gear 21 having a plurality of rotatable rollers 10, and comprising a center plate 11 having an edge 31 with a plurality of channels 32 axially formed in and evenly spaced about said edge of said plate for receiving, in use, said plurality of teeth 14 of said cam gear 13 and further including a first 28 and a second 29 side with a disc 27 secured to each said side for rotatably supporting therebetween each said roller of said plurality of rollers positioned next to each channel of said plurality of channels and with said cam gear and said roller gear in mechanical communication; and a housing 18 having an inlet port 19 and an outlet port 20 and an interior wall 18C substantially enclosing said cam gear 13 and said roller gear 21 such that, in use, upon rotation of said gears, each said roller sequentially rollingly contacts said housing thereby trapping a portion of fluid present in said inlet port 19 in a pocket 12 formed between adjacent rollers 10B and a portion 18B of said interior wall 18C of said housing between said adjacent rollers 10B and each said tooth sequentially proximately contacts said housing thereby trapping a portion of fluid present in said inlet port 19 in a chamber 26 formed between adjacent gear teeth 14B and a portion 18A of said internal wall 18C of said housing 18 in proximate contact with said adjacent gear teeth 14B and upon further rotation of said cam gear and said roller gear, transporting said trapped fluid in said pocket 12 and said chamber 26 to said outlet port 20 to enable pressurized fluid flow from said inlet port 19 to said outlet port 20.

13. The apparatus of claim 12 wherein adjacent teeth of said plurality of teeth of said cam gear form a notch 16 defining a lobular periphery having a pair of sides and with said plurality of teeth being equally spaced apart relative to one another; and said plurality 10A of rotatable rollers 10 of said roller gear being equally spaced apart relative to one another in rotational symmetry such that, in use, upon rotation of said cam gear and said roller gear, each said roller rollingly contacts one of said sides of said lobular periphery and rolls along said lobular periphery thereby decreasing friction upon mechanical engagement of said cam gear and said roller gear.

14. The apparatus of claim 13 wherein said roller and said cam gears are configured to provide at least one of said teeth of said cam gear to be in rolling contact with both a roller of said roller gear in an approach phase and with a roller of said roller gear in a recess phase to provide mechanical communication between said roller gear and said cam gear.

15. The apparatus of claim 13 wherein each said notch of said cam gear 13 further includes a circular-arc root 15 and each said roller having a surface contour to matingly receive said circular-arc root 15.

16. The apparatus of claim 13 wherein each said roller 10A of said roller gear 21 has an axisymmetrical shape, and each said notch 16 between said adjacent teeth 14B of said cam gear 13 and said inner surface of said housing 18 has a surface contour to matingly receive said axisymmetrical shape.

17. The apparatus of claim 12 wherein each tooth 14A of said plurality of teeth of said cam gear 13 includes a first side 14D and a second side 14E with each said side having at least one groove formed therein to enable fluid communication between said housing interior and a cavity 30 formed during meshing of said adjacent rollers 10B with one of said teeth 14A of said cam gear such that, in use, fluid trapped in said cavity 30 flows in said groove formed in one of said sides of said tooth to said outlet port 20 and upon further rotation of said meshed gears fluid in said inlet port flows in said groove formed in the remaining side of said tooth into said cavity 30.

18. The apparatus of claim 17 wherein each said side of each said tooth includes a pair of grooves 22, 23 formed therein and each said tooth includes a top land 17 with each said groove extending from said top land to a position where said roller closes off said grooves when said roller is positioned symmetrically between adjacent teeth of said cam gear.

19. The apparatus of claim 12 wherein said cam gear 13 and said roller gear 21 are each mounted on a shaft $0_1$, $0_2$, respectively, with said shafts being forced together in order to keep said shafts at a constant distance relative to one another to aid in preventing backlash displacement between said mating cam gear and said roller gear.

20. The apparatus of claim 12 wherein said cam gear 13 and said roller gear 21 are fixedly mounted on parallel shafts, respectively.

21. The apparatus of claim 12 wherein each said roller 10A of said roller gear 21 has a cylindrical shape, and each said tooth of said cam gear being positioned in a direction perpendicular to the plane of rotation.

22. The apparatus of claim 12 wherein said interior housing wall is contoured and each tooth of said plurality of teeth 14 of said cam gear 13 further includes a top land 17 which is shaped to fit said contour of said interior housing wall.

23. A pump-compressor apparatus comprising:

a cam gear 13 having a plurality of teeth 14 wherein adjacent teeth 14B of said plurality of teeth of said cam gear form a notch 16 which defines a lobular periphery having a pair of sides with a root 15 therebetween and with said plurality of teeth being equally spaced apart relative to one another;

a roller gear 21 having a plurality 10A of rotatable rollers 10 with each roller of said plurality of rotatable rollers having an axis and said roller gear and said cam gear configured to provide, in use, at least one of said teeth of said cam gear to be in rolling contact with both a roller of said plurality of rollers in an approach phase and with a roller of said plurality of rollers in a recess phase;

a housing 18 having an inlet port 19 and an outlet port 20 and an interior wall 18C substantially enclosing said cam gear 13 and said roller gear 21 such that, in use, upon rotation of said gears, each said roller sequentially rollingly contacts said housing thereby trapping a portion of fluid present in said inlet port 19 in a pocket 12 formed between adjacent rollers 10B and a portion 18B of said interior wall 18C of said housing between said adjacent rollers 10B and each said tooth sequentially proximately contacts said housing thereby trapping a portion of fluid present in said inlet port 19 in a chamber 26 formed between adjacent gear teeth 14B and a portion 18A of said internal wall 18C of said housing 18 in proximate contact with said adjacent gear teeth 14B and upon further rotation of said cam gear and said roller gear, transporting said trapped fluid in said pocket 12 and said chamber 26 to said outlet port 20 to enable pressurized fluid flow from said inlet port 19 to said outlet port 20.

24. The apparatus of claim 23 wherein each said notch of said cam gear 13 further includes a circular-arc root 15 and each said roller having a surface contour to matingly receive said circular-arc root 15.

25. The apparatus of claim 23 wherein each said roller 10A of said roller gear 21 has an axisymmetrical shape, and each said notch 16 between said adjacent teeth 14B of said cam gear 13 and said inner surface of said housing 18 has a surface contour to matingly receive said axisymmetrical shape.

26. The apparatus of claim 23 wherein said cam gear 13 and said roller gear 21 are each mounted on a shaft $0_1$, $0_2$, respectively, with said shafts being forced together in order to keep said shafts at a constant distance relative to one another to aid in preventing backlash displacement between said mating cam gear and said roller gear.

27. The apparatus of claim 23 wherein said cam gear 13 and said roller gear 21 are fixedly mounted on parallel shafts, respectively.

28. The apparatus of claim 23 wherein each said roller 10A of said roller gear 21 has a cylindrical shape, and each said tooth of said cam gear being positioned in a direction perpendicular to the plane of rotation.

29. The apparatus of claim 27 wherein said interior housing wall is contoured and each tooth of said plurality of teeth 14 of said cam gear 13 further includes a top land 17 which is shaped to fit said contour of said interior housing wall.

* * * * *